US005540394A

United States Patent [19]

Bremer et al.

[11] Patent Number: 5,540,394

[45] Date of Patent: Jul. 30, 1996

[54] ADJUSTER MECHANISM FOR GYRASPHERE CRUSHER CONCAVE

[75] Inventors: James C. Bremer, Slinger; Edward H. Breiling, West Allis, both of Wis.

[73] Assignee: Astec Industries, Inc., Chattanooga, Tenn.

[21] Appl. No.: 432,825

[22] Filed: May 2, 1995

[51] Int. Cl.[6] ..... B02C 2/00

[52] U.S. Cl. ..... 241/30; 241/207; 241/286

[58] Field of Search ..... 241/207–215, 241/286–290, 37, 30

[56] References Cited

U.S. PATENT DOCUMENTS

| | | |
|---|---|---|
| 3,201,053 | 8/1965 | Rumpel . |
| 3,350,019 | 10/1967 | Archer et al. . |
| 3,396,915 | 8/1968 | Allen . |
| 3,397,846 | 8/1968 | Archer . |

OTHER PUBLICATIONS

Operation and Maintenance Telsmith Model D Style 36 VFC and 48 VFC Crushers, p. 21.

*Primary Examiner*—Mark Rosenbaum

*Attorney, Agent, or Firm*—Nilles & Nilles, S.C.

[57] ABSTRACT

Apparatus for adjusting a conical concave crushing bowl of a gyrasphere crasher relative to a conical convex crashing head of the gyrasphere crasher includes a plurality of lugs connected to the conical concave crashing bowl; a bushing i) connected to the conical convex crashing head and ii) defining a bushing axis; and ii) defining a bushing axis a swivel bracket i) circumscribing an elongated trans cylinder release stud ii) defining a swivel axis that is coaxial with the bushing axis iii) adjacent the elongated bushing and iv) freely radially repositionable with regard to the swivel axis; and a tensioner having a proximal end attached to the swivel bracket and a distal end removably attached to one of the plurality of lugs. A method of adjusting the conical concave crashing bowl relative to the conical convex crashing head includes shortening the tensioner so as to rotate the conical concave crashing bowl relative to the conical convex crushing head.

20 Claims, 2 Drawing Sheets

ADJUSTER MECHANISM FOR GYRASPHERE CRUSHER CONCAVE

BACKGROUND OF THE INVENTION

1. Field of the Invention

The present invention relates generally to the field of gyrasphere crushers. More particularly, the present invention concerns adjusting the crushing gap of a gyrasphere crusher that includes a conical convex crushing head, a conical concave crushing bowl which is vertically adjustable relative to the head, and an adjustment assembly which permits vertical adjustment of the conical concave crushing bowl relative to the conical convex crushing head. Specifically, a preferred embodiment of the present invention is directed to an adjustment assembly that includes a bushing and a swivel bracket. The present invention thus relates to a gyrasphere crusher adjustment assembly of the type that can be termed swivelable.

2. Discussion of the Related Art

Heretofore, gyrasphere crushers have typically included a main frame that is stationary, a generally conical convex crushing head rotatably mounted on the main frame for gyration by an eccentric shaft, and a generally conical concave crushing bowl mounted on the main frame. The conical convex crushing head includes an upwardly facing convex crushing surface. Similarly, the conical concave crushing bowl includes a downwardly facing concave crushing surface. The conical concave crushing bowl is mounted on the main frame above the conical convex crushing head so as to define an annular crushing chamber. The minimum distance between upwardly facing convex crushing surface and the downwardly facing concave crushing surface defines a crushing gap having a scalar dimension G.

Material to be crushed is fed downwardly into the annular crushing chamber and is crushed by gyration of the convex crushing head by the eccentric shaft. The maximum particle size, as well as the particle size distribution, of the output from the gyrasphere crusher is dependent in part upon the magnitude of the crushing gap. Particle size adjustment and/or compensation for wear on the opposed crushing surfaces of the conical convex crushing head and the conical concave crushing bowl is thus possible by mounting the conical concave crushing bowl on the main frame for vertical movement with respect to the main frame, and therefore with respect to the conical convex crushing head. The crushing gap is widened by raising the conical concave crushing bowl or narrowed by lowering the conical concave crushing bowl. To permit such adjustment, the conical concave crushing bowl includes a crushing bowl frame that is threadedly connected to an upper portion of the main frame. The conical concave crushing bowl is raised or lowered by rotating the entire conical concave crushing bowl in the appropriate direction relative to the main frame.

When satisfactorily adjusted, the conical concave crushing bowl must be locked in place or substantially prevented from rotating relative to the main frame in response to the tangential forces imposed upon it by the gyrating crushing head. This locking is typically performed via a conventional locknut or jam nut. A substantial clamping force is normally exerted between the conical concave crushing bowl and the locknut to urge them axially towards one another. For adjusting the conical concave crushing bowl, this clamping force is released.

A previously recognized problem has been that a significant amount of force is needed to rotate the conical concave crushing bowl. What is needed therefore is an apparatus that provides enough force to rotate the conical concave crushing bowl. Such apparatus must be strong, durable, reliable under harsh operating conditions, and economical. Heretofore these requirements have not been fully met without incurring various disadvantages.

One previously recognized solution to the problem of adjusting the crushing gap G was to rotate the conical concave crushing bowl by means of a chain attached between a lug that is connected to the conical concave crushing bowl and a rigid puller post connected to the stationary main frame. This solution is disclosed at page 21 of Operation and Maintenance Telsmith Model D Style 36 VFC and 48 VFC Crushers. According to this solution, the chain is shortened with a chain puller, thereby rotating the conical concave crushing bowl. A disadvantage of this previously recognized solution is that tools must be used to reverse the orientation of the entire rigid puller post when the direction of rotation is to be reversed so as to avoid bending the rigid post puller when the chain is shortened. Further, this previously recognized solution also has the disadvantage that the threads of the stud to which the rigid puller post is attached may become damaged due to the large amount of force that is applied to the rigid puller post by the chain puller. Such damage is cumulative and particularly likely to occur if the rigid post puller is cross-threaded onto the stud due to ordinary wear and tear, or human error. Significantly, such damage may prevent reorientation of the rigid puller post and/or impede removal of the associated stud.

The below-referenced U.S. patents disclose embodiments that were at least in-part satisfactory for the purposes for which they were intended but which had certain disadvantages.

U.S. Pat. No. 3,397,846 discloses a hydraulic piston for applying force to a chain so as to thereby rotate a concave crushing bowl. The free end of the chain is disclosed to be engaged with a chain wheel provided with a ratchet and a spring pressed pawl.

U.S. Pat. No. 3,396,915 discloses a pair of hydraulic pistons for applying force to a concave crushing bowl so as to thereby rotate the bowl. The crushing bowl can be rotated in either direction.

U.S. Pat. No. 3,350,019 discloses a continuous chain for continuously rotating a concave crushing bowl. The bowl can be rotated in either direction without manual adjustment.

U.S. Pat. No. 3,201,053 discloses a hydraulic piston for applying force to a chain so as to thereby rotate a concave crushing bowl. The free end of the chain is hooked around the bracket to which the hydraulic piston is attached.

In embodiments disclosed in the above-referenced prior patents, apparatus for rotating a conical concave crushing bowl is disclosed as being either electrical or hydraulic. As indicated above, such apparatus has the disadvantage that it is not entirely reliable under harsh operating conditions. Further, as indicated above, such apparatus also has the disadvantage that it is relatively complex for the task and is not economical.

SUMMARY OF THE INVENTION

It is therefore a principle object of the present invention is to provide an adjustment assembly for a gyrasphere crusher that permits rapid reorientation of a puller plate without the use of tools.

Another object of the present invention is to provide an adjustment assembly that positions moving parts of the adjustment assembly away from the main frame of the gyrasphere crusher so as to obviate interference in the operation of the adjustment assembly by the main frame.

A further object of the present invention is to provide an adjustment assembly having a chain that can be safely attached to a lug connected to the conical concave crushing bowl.

A further object of the invention to provide an adjustment assembly that is reliable under harsh operating conditions, thereby decreasing down time and operating costs.

A further object of the invention is to provide a strong and durable adjustment assembly that can be operated by relatively low skilled workers.

A further object of the invention is to provide an adjustment assembly which has one or more of the characteristics discussed above but which is relatively simple to manufacture and assemble.

In accordance with a first aspect of the invention, these objects are achieved by providing an apparatus for adjusting a conical concave crushing bowl of a gyrasphere crusher relative to a conical convex crushing head of said gyrasphere crusher, said conical concave crushing bowl having a crushing bowl frame that is threadedly connected to an upper portion of a main frame of said gyrasphere crusher, said apparatus comprising: a plurality of lugs connected to said conical concave crushing bowl; a bushing i) connected to said conical convex crushing head and ii) defining a bushing axis that is substantially coaxial with said stud axis; a swivel bracket i) circumscribing said elongated stud ii) defining a swivel axis that is substantially coaxial with said bushing axis iii) adjacent said bushing and iv) freely radially repositionable with regard to said swivel axis; and a tensioner having a proximal end attached to said swivel bracket and a distal end removably attached to one of said plurality of lugs.

Preferably, said tensioner includes i) a chain having a concave link that is removably attached to said one of said plurality of lugs. Said tensioner also preferably includes a chain puller that is attached to said chain.

Yet another object of the invention is to provide a method of adjusting a gyrasphere crusher concave which has one or more of the characteristics discussed above.

In accordance with another aspect of the invention, these objects are achieved by providing a method of adjusting a conical concave crushing bowl of a gyrasphere crusher relative to a conical convex crushing head of said gyrasphere crusher comprising: providing said gyrasphere crusher with said conical concave crushing bowl and said conical convex crushing head, the conical concave crushing bowl having a crushing bowl frame that is threadedly connected to an upper portion of a main frame of said gyrasphere crusher; providing a plurality of lugs connected to said conical concave crushing bowl; providing an elongated bushing i) connected to said conical convex crushing head; an elongated bushing i) circumscribing said elongated stud and ii) defining a bushing axis that is coaxial with said stud axis; providing a swivel bracket i) circumscribing said elongated stud ii) defining a swivel axis that is coaxial with said bushing axis iii) adjacent said elongated bushing and iv) freely radially repositionable with regard to said swivel axis; providing a tensioner having a proximal end attached to said swivel bracket and a distal end removably attached to one of said plurality of lugs; positioning said swivel bracket with regard to said swivel axis; and shortening said tensioner so as to rotate said conical concave crushing bowl relative to said conical convex crushing head so as to adjust said conical concave crushing bowl relative to said conical convex crushing head.

An effect of the present invention is to permit self-adjusting reorientation of a swivel bracket while the adjustment assembly is tightened.

Other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical gyrasphere crusher mechanisms provided with the present invention, will become more readily apparent by referring to the exemplary, and therefore non-limiting, embodiments illustrated in the drawings accompanying and forming a part of this specification, wherein like reference numerals designate the same elements in the several views and in which.

DESCRIPTION OF PREFERRED EMBODIMENTS

1. System Overview

Figure 1:
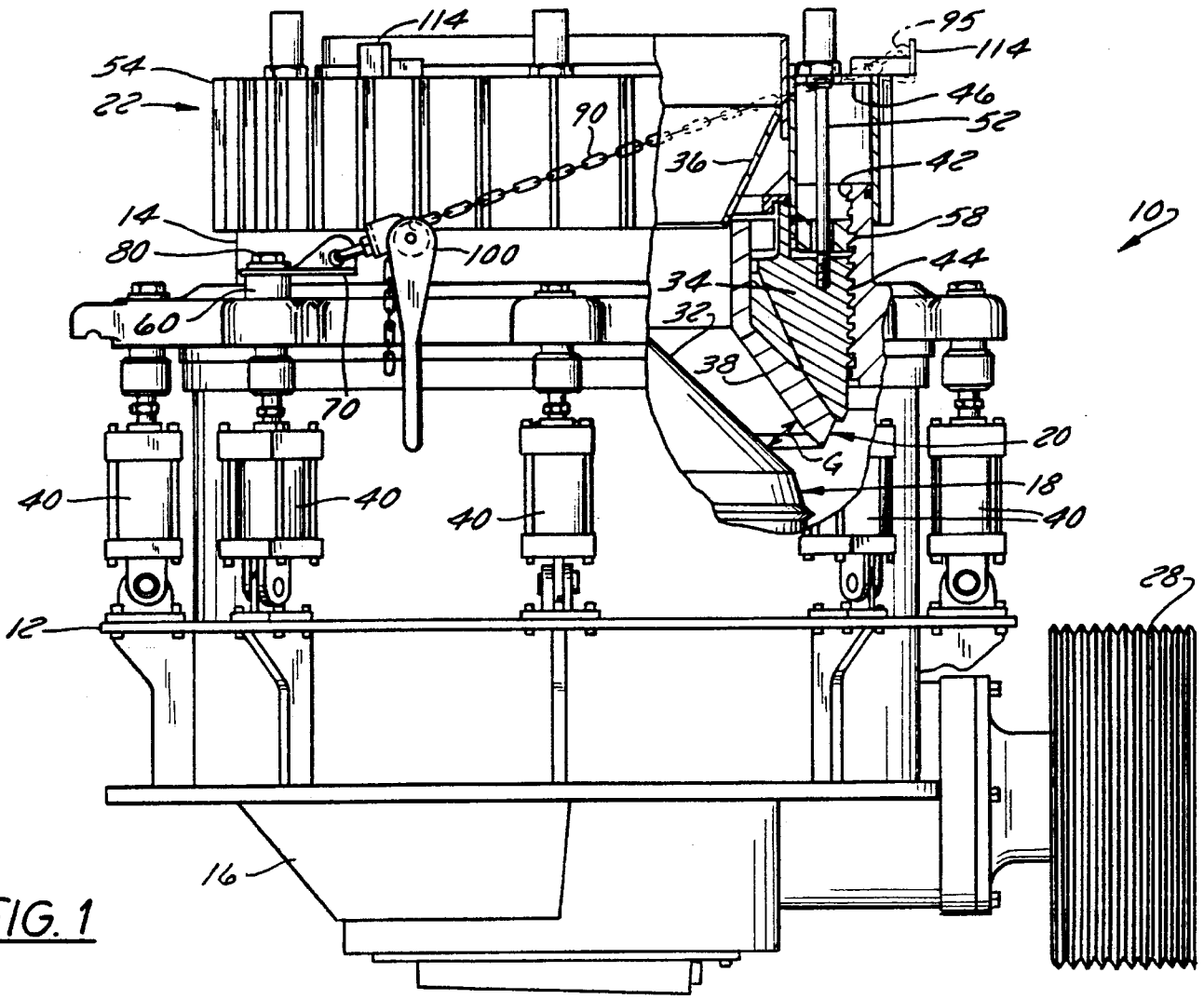
FIG. 1 illustrates a partially cut away elevation view of a gyrasphere crusher according to the present invention.
Figure 2:
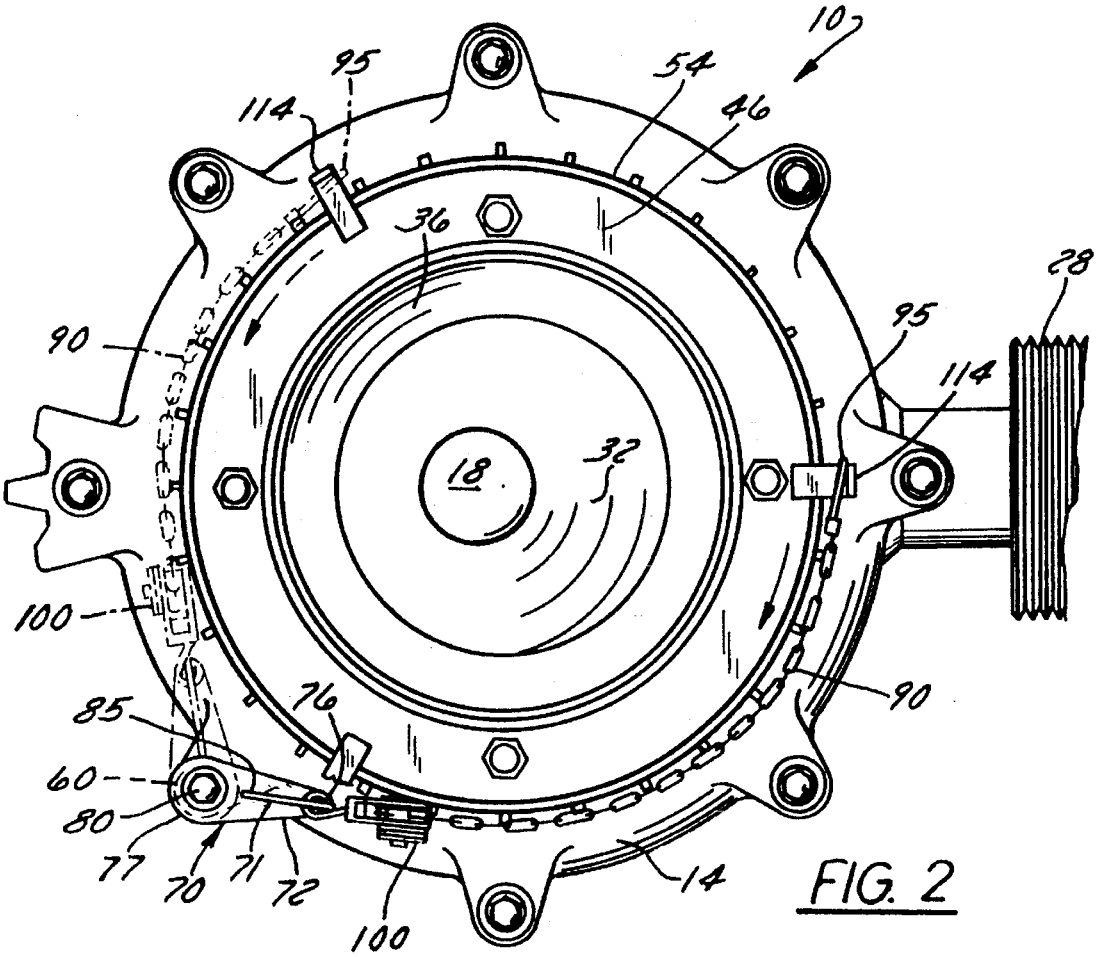
FIG. 2 illustrates a top plan view of the gyrasphere crusher shown in FIG. 1.

Referring to the drawings, and to FIGS. 1–2 in particular, a gyrasphere crusher is illustrated and includes a main frame 12 having upper and lower portions 14 and 16, a conical convex crushing head 18 mounted in the main frame lower portion 16, and a conical concave crushing bowl 20 mounted in main frame upper portion 14 above the conical convex crushing head 18. The conical concave crushing bowl 20 is normally held fast from rotation with respect to the main frame upper portion 14 by a conical concave crushing bowl lock assembly 22, but the conical concave crushing bowl lock assembly 22 is selectively, at least partially, releasable to permit vertical adjustment of the conical concave crushing bowl 20 relative to the conical convex crushing head 18 by an adjustment assembly as detailed below. The conical convex crushing head 18 is mounted in main frame lower portion by an eccentric shaft which is rotatably journaled in the main frame lower portion 16 and connected to a drive pulley 28 by a conventional torque transfer system. The conical convex crushing head 18 also presents an upper generally conical convex crushing surface 32 formed from a replaceable liner. The conical convex crushing head 18 and its drive system are conventional and, accordingly, will not be described in further detail.

The main frame upper portion 14 is supported on the main frame lower portion 16 by a plurality of tramp relief cylinders 40 which can be selectively actuated for tramp relief purposes in a manner which is, per se, well known and which forms no part of the present invention. As is conventional in the art, the bowl 20 is normally locked in place by a locknut 46 capped with a locknut cover 54.

The conical concave crushing bowl 20 includes a crushing bowl frame 34, an upper uncrushed rock feed hopper 36, and a hardened lower conical concave crushing bowl surface 38 which is formed from a replaceable liner. Hardened lower conical concave crushing bowl surface 38 surrounds the upper generally conical convex crushing surface 32 of the conical convex crushing head 18 and is spaced above it to define a crushing gap G forming an annular crushing chamber. In order to permit vertical adjustment of the conical concave crushing bowl 20 relative to the main frame 12 and thus to permit adjustment of the thickness of gap G, a helically threaded connection is provided between the conical concave crushing bowl 20 and the main frame 12 in the form of an internal helical thread 42 on the main frame upper portion 14 and an external helical thread 44 on the crushing bowl frame 34 of conical concave crushing bowl 20.

2. Construction of Adjustment Assembly

Figure 3:
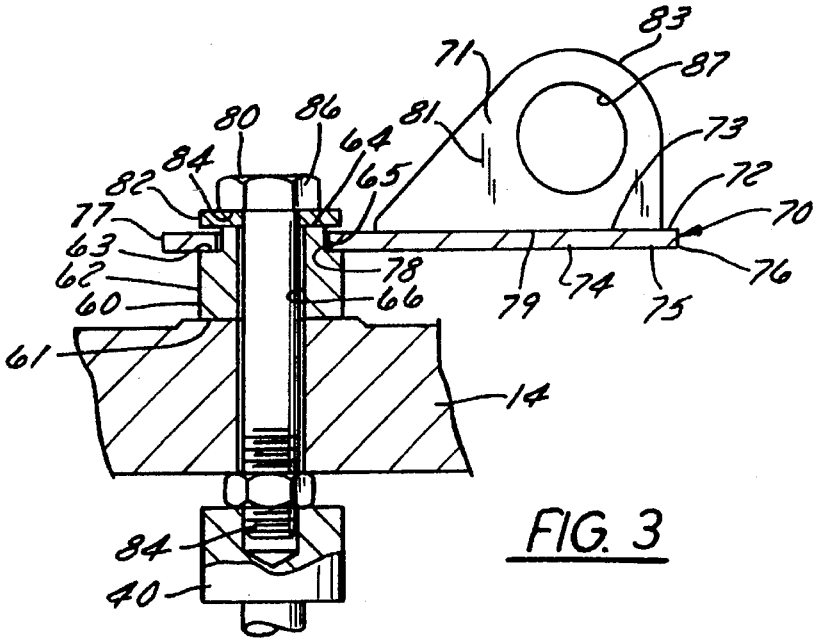
FIG. 3 illustrates a sectional elevation view of a portion of the gyrasphere crusher shown in FIGS. 1 and 2.

Referring to FIGS. 1–3, an adjustment assembly is provided for rotating the crushing bowl 20 about threads 42, 44. The adjustment assembly includes an elongated bushing 60 that is attached to the crushing bowl frame 34 and a swivel bracket 70 that is adjacent the elongated bushing 60. Swivel bracket 70 and elongated bushing 60 are connected to main frame 12 with an elongated stud 80. Swivel bracket 70 is freely radially repositionable with regard to crushing bowl frame 34 and main frame 12.

The adjustment assembly also includes a tensioner for rotating the conical concave crushing bowl 20 relative to the conical convex crushing head 18. The tensioner preferably includes a chain 90 having a concave link 95 that can be selectively attached to and detached from one of a plurality of lugs 114 equally spaced about locknut cover 54. The tensioner also preferably includes a chain puller 100 attached to the chain 90. The chain puller 100 permits the tensioner to be shortened so as to adjust the conical concave crushing bowl 20 relative to the conical convex crushing head 18.

Although the chain puller 100 of the preferred embodiment is disposed closely attached to the swivel bracket 70, it is within the level of ordinary skill in the art after having knowledge of the invention disclosed herein to provide alternative tensioners; located at any point along the adjustment assembly between one of the lugs 114 and the swivel bracket 70.

Referring now to FIG. 2, the adjustment assembly according to the present invention can be seen from the top; attached to the gyrasphere crusher 10. The radial repositionability of the swivel bracket 70 can be more clearly appreciated from this perspective.

Swivel bracket 70 includes a vertical puller plate 71 and a horizontal swivel plate 72. By repositioning swivel bracket 70, the principal plane defined by puller plate 71 can be directed toward the lug to which the concave link 95 is removably attached. Assuming that the direction of rotation of the locknut 46 is to be reversed, the concave link 95 is removed from a first lug. The swivel bracket is then repositioned toward a second lug 114. Finally the concave link 95 is attached to the second lug, thereby permitting shortening of the tensioner and consequential rotation of locknut 46 in the reverse direction.

Although the preferred embodiment shown in FIG. 2 includes three lugs 114 welded to the locknut cover 54, it is within the level of ordinary skill in the art after having knowledge of the invention disclosed herein to connect any number of lugs in any manner to any portion of the gyrasphere crusher that is attached to the conical concave crushing bowl 20.

Referring now to FIG. 3, the swivel bracket 70 can be seen from the side; attached to frame upper portion 14 by the elongated stud 80. Elongated stud 80 is preferably an elongated tramp release cylinder stud, thereby providing a convenient way to attach swivel bracket 70 without the need to redesign the gyrasphere crusher. Elongated stud 80 has (1) a distal end 84 that is threaded into the tramp release cylinder 40 and (2) a proximal end 86 having a bolt head that includes a bolt surface 88 that is adjacent a washer 82.

Elongated bushing 60 circumscribes elongated stud 80 and defines a bushing axis that is substantially coaxial with an axis defined by elongated stud 80. Swivel bracket 70 circumscribes elongated stud 80 and defines a swivel axis that is substantially coaxial with the bushing axis. Swivel bracket 70 is mounted on bushing 60 and is loosely held in place by washer 82 so as to be freely radially repositionable with regard to the swivel axis.

Elongated bushing 60 includes a bushing bottom surface 61 that is substantially perpendicular to the bushing axis. Elongated bushing 60 includes a bushing outer surface 62 having a height of from approximately 1.875" to approximately 3.375" Bushing 60 has an outer surface 62 which is contiguous with bushing bottom surface 61 and which has an outer diameter of from approximately 4" to approximately 5" which is substantially coaxial with the bushing axis. Elongated bushing 60 includes a bushing shoulder surface 63 having a width of approximately 0.563". Bushing shoulder surface 63 is contiguous with bushing outer surface 62 and substantially perpendicular to the bushing axis. When the adjustment assembly is not in use, most of the weight of swivel bracket 70 bears on bushing shoulder surface 63.

Elongated bushing 60 also includes a bushing bearing surface 65 which has a height of approximately 0.625". Bushing bearing surface 65 is contiguous with bushing shoulder surface 63 and defines a bushing bearing diameter that is substantially coaxial with the bushing axis. When the adjustment assembly is in use, most of the force generated by the tensioner bears on bushing bearing surface 65.

Elongated bushing 60 includes a bushing top surface that is substantially flat. Bushing top surface 64 is contiguous with bushing bearing surface 65 and substantially perpendicular to the bushing axis. The elongated bushing 60 also includes a bushing inner surface 66 that is contiguous with the bushing top surface 64 as well as with bushing bottom surface 61. The bushing inner surface 66 defines a bushing inner diameter of from approximately 1.65" to approximately 2.63" which is substantially coaxial with the bushing axis. Bushing inner surface 66 circumscribes elongated stud 80. In order to permit operating access to the adjustment assembly, the height of bushing outer surface 62 is selected, in conjunction with the configuration of the other components of the adjustment assembly, to permit swivel bracket 70 to be freely repositioned and also to permit operation of the tensioner without interference from the other components.

The swivel plate 72 of swivel bracket 70 preferably has a thickness of approximately 0.50". Swivel plate 72 is adjacent the bushing shoulder surface 63, as well as the bushing bearing surface 65, of elongated bushing 60. Swivel plate 72 defines a swivel plate plane that is substantially perpendicular to the swivel axis.

Swivel plate 72 includes a first swivel plate surface 73 that is substantially flat and substantially perpendicular to the swivel axis. Swivel plate 72 includes a swivel plate edge 74 that is contiguous with the first swivel plate surface 73.

Referring again to FIG. 2, swivel plate edge 74 includes a first swivel plate radius of curvature 76 with an approximate dimension of 1.0". Swivel plate edge 74 includes a second swivel plate radius of curvature 77 with a dimension of from approximately 3.0" to approximately 3.25".

Referring again to FIG. 3, swivel plate edge 74 is substantially parallel with the swivel axis. Swivel plate 72 includes a swivel plate radial surface 78 having a diameter from approximately 3.0" to approximately 4.0" defining a swivel plate hole axis that is substantially coaxial with the swivel plate axis. Swivel plate 72 includes a second swivel plate surface 75 that is substantially flat and contiguous with the swivel plate edge 74. Second swivel plate surface 75 is substantially perpendicular to the swivel axis.

Swivel bracket 70 includes a puller plate 71 having a thickness of approximately 0.50". Puller plate 71 is attached to swivel plate 72 and defines a puller plate plane that is substantially coplaner with the swivel axis. The puller plate 71 includes a flat puller plate edge 79 that has a length of approximately 8.0". The flat puller plate edge 79 is preferably welded to the first swivel plate surface 73. Puller plate 71 includes a first puller plate surface 81 that is substantially flat, contiguous with the flat puller plate edge 79 and substantially parallel to the puller plate plane. Puller plate 71 includes a curved puller plate edge 83 which has a puller plate radius of curvature of approximately 2.5". Curved puller plate edge 83 is contiguous with first puller plate surface 81.

Referring again to FIG. 2, puller plate 71 includes a second puller plate surface 85 that is substantially flat and contiguous with both flat puller plate edge 79 and curved puller plate edge 83. Second puller plate surface 85 is substantially parallel with the puller plate plane.

Referring again to FIG. 3, puller plate 71 includes a puller plate radial surface 87 having a diameter of approximately 3.0". Puller plate radial surface 87 defines a puller plate hole axis that is substantially perpendicular to both the puller plate plane and the swivel axis. At least a portion of the puller plate 71 is constantly canted upward away from the swivel plate radial surface 78 and acutely angled with respect to the first swivel plate surface 73 at an angle of from approximately 40° to approximately 50°, preferably 45°.

The constant canting upwards of the swivel plate radial surface 78 provides maximum strength per unit of material used and allows for ease of manufacture. Similarly, the accurately angled characteristic allows for maximum strength per unit material. Further, an angle from approximately 40° to approximately 50° provides optimum stiffening of swivel plate 72 as a function of the distance from the swivel axis. This feature permits the bulk of the tension generated by shortening the chain to be transmitted to bushing bearing surface 65; not to washer 82. The angle of approximately 45° provides the best combination of stiffening and shortening for transfer. Puller plate 71 can be provided with a truncated angle edge that is contiguous with both curved puller plate edge 83 and flat puller plate edge 79.

Although the preferred embodiment shown in FIG. 3 includes the elongated stud having the threaded distal end connected to the tramp release cylinder, it is within the level of ordinary skill in the art after having knowledge of the invention disclosed herein to connect the swivel bracket to any portion of the gyrasphere crusher that is attached to the conical convex crushing head.

The disclosed embodiment shows a chain puller as the structure for performing the function of tensioning, but the structure for tensioning can include any other structure capable of performing the function of the chain puller, including, by way of example a cable puller, a winch or a turnbuckle.

Conveniently, the swivel of the present invention can be made of any strong material. For the manufacturing operation, it is moreover an advantage to employ a metallic material such as steel.

3. Operation of the System

During normal operation of the gyrasphere crusher 10, rocks or stones are fed to the upper uncrushed rock feed hopper 36 from a screen or the like and fall into the crushing cavity where they are crushed between the hardened lower conical concave crushing bowl surface 38 of the conical concave crushing bowl 20 and the upper generally conical convex crushing surface 32 of the conical convex crushing head 18 upon eccentric rotation of the conical convex crushing head 18 about a shaft that is connected to drive pulley 28. The maximum particle size of the crushed rock thus produced is defined by the thickness of the gap G formed between the conical convex crushing head 18 and the conical concave crushing bowl 20. The conical concave crushing bowl 20 is locked in place at this time by clamping forces exerted by locknut 46. Locknut 46 includes locknut threads 58. Locknut 46 is connected to a fluid pressure-applied or released lock assembly via studs 52. Most conventional fluid pressure-applied or released lock assemblies require hydraulic pressures in the range of 5,000 to 10,000 psi to lock or release locknuts.

4. Operation of the Adjustment Assembly

Assuming now that it is desired to adjust vertically the conical concave crushing bowl 20 relative to the main frame 12 and conical convex crushing head 18, at least a portion of the clamping forces applied to the locknut 46 are released. The adjustment assembly is actuated to pull one of a plurality of lugs 114 on the locknut cover 54 tangentially, thereby rotating the locknut cover 54 and hence rotating the locknut 46. Rotational motion of locknut 46 is transferred to the conical concave crushing bowl 20 through the studs 52 so that the locknut 46 and conical concave crushing bowl 20 rotate about the threads 42, 44, 58 to vertically adjust the conical concave crushing bowl 20, thereby adjusting the thickness of the crushing gap G.

Conveniently, the shortening of the chain of the present invention can be carried out by using any shortening method such as ratcheting a chain puller or cable puller, winding a winch or rotating a turnbuckle. For slight shortening of the chain while the gyrasphere crusher 10 is under load, it is moreover an advantage to employ a remotely actuated method of automatically shortening the chain such as a remotely actuated winch.

Although the best mode contemplated by the inventors of carrying out the present invention is disclosed above, practice of the present invention is not limited thereto. Numerous changes in the details of the parts, the arrangement of the parts and the construction of the subcombinations will be readily apparent to one of ordinary skill in the art without departing from the spirit and scope of the underlying inventive concept. For example, the manufacturing design of the swivel bracket could be enhanced by providing a one piece cast swivel bracket. In addition, although a bushing is preferred for simplicity, any other structure that permits pivoting of the swivel bracket could be used in its place, such as ball bearings or roller bearings.

Moreover, while there are shown and described herein certain specific combinations embodying the present invention for the purpose of clarity of understanding, practice of the present invention is not limited thereto. It will be manifest to those of ordinary skill in the art that various additions, modifications and rearrangements of the features of the present invention may be made without deviating from the spirit and scope of the underlying inventive concept.

It is intended that the appended claims cover all such changes, modifications and rearrangements. Expedient embodiments of the present invention are differentiated by the appended subclaims.

What is claimed is:

1. A gyrasphere crusher comprising:

a main frame;

a conical convex crushing head mounted on said main frame;

a conical concave crushing bowl mounted on said conical convex crushing head, said conical concave crushing bowl having a crushing bowl frame that is threadedly connected to an upper portion of said main frame; and an apparatus for adjusting said conical concave crushing bowl relative to said conical convex crushing head, said apparatus including a plurality of lugs connected to said conical concave crushing bowl;

an elongated bushing i) connected to said conical convex crushing head and ii) defining a bushing axis;

a swivel bracket i) defining a swivel axis that is substantially coaxial with said bushing axis ii) mounted on said elongated bushing and iii) freely radially repositionable with regard to said swivel axis; and a tensioner having a proximal end attached to said swivel bracket and a distal end removably attached to one of said plurality of lugs.

2. The gyrasphere crusher of claim 1, wherein said elongated bushing includes:

a bushing bottom surface that is substantially perpendicular to said bushing axis;

a bushing outer surface that i) is contiguous with said bushing bottom surface and ii) defines an outer diameter that is substantially coaxial with said bushing axis;

a bushing shoulder surface that is i) contiguous with said bushing outer surface and ii) substantially perpendicular to said bushing axis;

a bushing bearing surface that i) is contiguous with said bushing shoulder surface and ii) defines a bearing diameter that is substantially coaxial with said bushing axis;

a bushing top surface that is i) contiguous with said bushing bearing surface and ii) substantially perpendicular to said bushing axis; and a bushing inner surface that i) is contiguous with said bushing top surface and said bushing bottom surface, and ii) defines an inner diameter that is substantially coaxial with said bushing axis.

3. The gyrasphere crusher of claim 2, further comprising:

an elongated stud i) connected to said conical convex crushing head and ii) defining a stud axis; and a washer which i) circumscribes said elongated stud and ii) is located adjacent said swivel bracket.

4. The gyrasphere crusher of claim 3, wherein said elongated stud includes a distal end that is threaded and a proximal end having a bolt head that is adjacent said washer.

5. The gyrasphere crusher of claim 4, wherein said distal end of said elongated stud is attached to a tramp release cylinder.

6. The gyrasphere crusher of claim 5, wherein said tensioner includes i) a chain having a concave link that is removably attached to said one of said plurality of lugs and ii) a chain puller that is attached to said chain.

7. The gyrasphere crusher of claim 5, wherein said tensioner includes i) a cable having a concave link that is removably attached to said one of said plurality of lugs and ii) a cable puller that is attached to said cable.

8. The gyrasphere crusher of claim 1, further comprising an elongated stud connected to said conical convex crushing head; and wherein said swivel bracket includes:

a swivel plate that i) is adjacent said elongated bushing, ii) circumscribes said elongated stud and iii) defines a swivel plate plane that is substantially perpendicular to said swivel axis, said swivel plate including:

a first swivel plate surface that is substantially perpendicular to said swivel axis;

a swivel plate edge that is i) contiguous with said first swivel plate surface and ii) substantially parallel with said swivel axis;

a swivel plate radial surface defining a swivel plate hole axis that is substantially coaxial with said swivel plate axis; and a second swivel plate surface that is i) contiguous with said swivel plate edge and ii) substantially perpendicular to said swivel axis; and a puller plate that i) is fixedly attached to said swivel plate and ii) defines a puller plate plane that is substantially coplaner with said swivel axis, said puller plate including:

a flat puller plate edge that is fixedly attached to said first swivel plate surface;

a first puller plate surface that is i) contiguous with said flat puller plate edge and ii) substantially parallel to said puller plate plane;

a curved puller plate edge that is contiguous with said first puller plate surface;

a second puller plate surface that is i) contiguous with said flat puller plate edge, ii) contiguous with said curved puller plate edge, and iii) substantially parallel to said puller plate plane; and a puller plate radial surface defining a puller plate hole axis that is substantially perpendicular to both said puller plate plane and said swivel axis, at least a portion of said puller plate being canted upwardly away from said swivel plate radial surface and acutely angled with respect to said first swivel plate surface.

9. The gyrasphere crusher of claim 8, further comprising a washer which i) circumscribes said elongated stud and ii) is located adjacent said swivel bracket.

10. The gyrasphere crusher of claim 9, wherein said elongated stud includes a distal end that is threaded and a proximal end having a bolt head having a bolt surface that is adjacent said washer.

11. The gyrasphere crusher of claim 10, wherein said distal end of said elongated stud is attached to a tramp release cylinder.

12. The gyrasphere crusher of claim 11, wherein said tensioner includes i) a chain having a concave link that is removably attached to said one of said plurality of lugs and ii) a chain puller that is attached to said chain.

13. The gyrasphere crusher of claim 12, wherein said chain puller includes a manually actuated ratchet lever.

14. The gyrasphere crusher of claim 1, further comprising an elongated stud connected to said conical convex crushing head; and wherein said elongated bushing includes:

a bushing bottom surface that is flat and perpendicular to said bushing axis;

a bushing outer surface that has a height of from 1.875" to 3.375" and that i) is contiguous with said bushing bottom surface and ii) defines a bushing outer diameter of from 4" to 5" that is coaxial with said bushing axis;

a bushing shoulder surface that has a width of 0.563" and that is i) contiguous with said bushing outer surface and ii) perpendicular to said bushing axis;

a bushing bearing surface that has a height of 0.625" and that i) is contiguous with said bushing shoulder surface and ii) defines a bushing bearing diameter that is coaxial with said bushing axis;

a bushing top surface that is i) flat, ii) contiguous with said bushing bearing surface and iii) perpendicular to said bushing axis; and a bushing inner surface that i) is contiguous with said bushing top surface and said bushing bottom surface, ii) defines a bushing inner diameter of from 1.625" to 2.63" that is coaxial with said bushing axis, and iii) circumscribes said elongated stud, and wherein said swivel bracket includes:

a swivel plate that i) has a thickness of 0.50", ii) is adjacent said elongated bushing and iii) defines a swivel plate plane that is perpendicular to said swivel axis, said swivel plate including:

a first swivel plate surface that is flat and perpendicular to said swivel axis;

a swivel plate edge that i) has a first swivel plate radius of curvature of 1.0", ii) has a second swivel plate radius of curvature of from 3.0" to 3.25", iii) is contiguous with said first swivel plate surface and iv) is parallel with said swivel axis;

a swivel plate radial surface having a diameter of from 3.0" to 4.0" defining a swivel plate hole axis that is coaxial with said swivel plate axis;

a second swivel plate surface that is i) flat, ii) contiguous with said swivel plate edge and ii) perpendicular to said swivel axis; and a puller plate that i) has a thickness of 0.50" ii), is attached to said swivel plate and iii) defines a puller plate plane that is coplaner with said swivel axis, said puller plate including:

a flat puller plate edge that i) has a length of 8.0" and ii) is welded to said first swivel plate surface:

a first puller plate surface that is i) flat, ii) contiguous with said flat puller plate edge and iii) parallel to said puller plate plane;

a curved puller plate edge that i) has a puller plate radius of curvature of 2.5" and ii) is contiguous with said first puller plate surface;

a second puller plate surface that is i) flat, ii) contiguous with said flat puller plate edge, iii) contiguous with said curved puller plate edge, and iv) parallel to said puller plate plane; and a puller plate radial surface having a diameter of 3.0" and defining a puller plate hole axis that is perpendicular to both said puller plate plane and said swivel axis, at least a portion of said puller plate being constantly canted upwardly away from the swivel plate radial surface and acutely angled with respect to the first swivel plate surface at an angle of from 40° to 50°.

15. The gyrasphere crusher of claim 14, further comprising a washer which i) circumscribes said elongated stud and ii) is located adjacent said swivel bracket.

16. The gyrasphere crusher of claim 15, wherein said elongated stud includes a distal end that is threaded and a proximal end having a bolt head having a bolt surface that is adjacent said washer.

17. The gyrasphere crusher of claim 16, wherein said distal end of said elongated stud is attached to a tramp release cylinder.

18. The gyrasphere crusher of claim 17, wherein said tensioner includes i) a chain having a concave link that is removably attached to said one of said plurality of lugs and ii) a chain puller that is attached to said chain.

19. A gyrasphere crusher comprising:

a main frame having an upper portion;

a conical concave crushing bowl threadedly rotatably connected to said upper portion of said main frame;

a conical convex crushing head rotatably attached to said main frame;

an apparatus for adjusting said conical concave crushing bowl relative to said conical convex head, said apparatus comprising:

a plurality of lugs connected to said conical concave crushing bowl;

an elongated tramp release cylinder stud i) connected to said conical convex crushing head and ii) defining a stud axis;

an elongated bushing i) circumscribing said elongated tramp release cylinder stud and ii) defining a bushing axis that is substantially coaxial with said stud axis, said elongated bushing including:

a bushing bottom surface that is substantially perpendicular to said bushing axis;

a bushing outer surface that i) is contiguous with said bushing bottom surface and ii) defines a bushing outer diameter that is substantially coaxial with said bushing axis;

a bushing shoulder surface that is i) contiguous with said bushing outer surface and ii) substantially perpendicular to said bushing axis;

a bushing bearing surface that i) is contiguous with said bushing shoulder surface and ii) defines a bearing diameter that is substantially coaxial with said bushing axis;

a bushing top surface that is i) contiguous with said bushing bearing surface and ii) substantially perpendicular to said bushing axis; and a bushing inner surface that i) is contiguous with both said bushing top surface and said bottom surface, ii) defines a bushing inner diameter that is substantially coaxial with said bushing axis, and iii) circumscribes said elongated tramp release cylinder stud;

a swivel bracket i) circumscribing said elongated tramp release cylinder stud, ii) defining a swivel axis that is substantially coaxial with said bushing axis, iii) mounted on said elongated bushing and iv) freely radially repositionable with regard to said swivel axis, said swivel bracket including:

a swivel plate that i) is adjacent said elongated bushing and ii) defines a swivel plate plane that is substantially perpendicular to said swivel axis, said swivel plate including:

a first swivel plate surface that is substantially perpendicular to said swivel axis;

a swivel plate edge that is i) contiguous with said first swivel plate surface and ii) substantially parallel with said swivel axis;

a swivel plate radial surface defining a swivel plate hole axis that is substantially coaxial with said swivel plate axis; and a second swivel plate surface that is i) contiguous with said swivel plate edge and ii) substantially perpendicular to said swivel axis; and a puller plate that i) is attached to said swivel plate and ii) defines a puller plate plane that is substantially coplaner with said swivel axis, said puller plate including:

a flat puller plate edge that is fixedly attached to said first surface of said swivel plate;

a first puller plate surface that is i) contiguous with said flat puller plate edge and ii) substantially parallel to said puller plate plane;

a curved puller plate edge that is contiguous with said first puller plate surface;

a second puller plate surface that is i) contiguous with said flat puller plate edge, ii) contiguous with said curved puller plate edge, and iii) substantially parallel to said puller plate plane; and a puller plate radial surface defining a puller plate hole axis that is substantially perpendicular to said puller plate plane and said swivel axis, at least a portion of said puller plate being canted upwardly away from said swivel plate radial surface and acutely angled with respect to said first swivel plate surface;

a washer circumscribing said elongated tramp release cylinder stud and adjacent said swivel bracket; and a tensioner including i) a proximal end attached to said swivel bracket, ii) a chain having a concave link that is removably attached to said one of said plurality of lugs and iii) a chain puller that is attached to said chain, wherein said elongated tramp release cylinder stud includes a distal end that is threaded and a proximal end having a bolt head having a bolt surface that is adjacent said washer, said distal end of said elongated stud being attached a tramp release cylinder that is attached to said main frame.

20. A method of adjusting a conical concave crushing bowl of a gyrasphere crusher relative to a conical convex crushing head of said gyrasphere crusher comprising:

providing said gyrasphere crusher with said conical concave crushing bowl and said conical convex crushing head, the conical concave crushing bowl having a crushing bowl frame that is threadedly connected to an upper portion of a main frame of said gyrasphere crusher;

providing a plurality of lugs connected to said conical concave crushing bowl; providing an elongated bushing i) connected to said conical concave crushing bowl and ii) defining a bushing axis;

providing an elongated stud connected to said conical convex crushing head;

providing a swivel bracket i) circumscribing said elongated stud, ii) defining a swivel axis that is substantially coaxial with said bushing axis; iii) being located adjacent said elongated bushing, and iv) being freely radially repositionable with regard to said swivel axis;

providing a tensioner having a proximal end attached to said swivel bracket and a distal end removably attached to one of said plurality of lugs;

positioning said swivel bracket with regard to said swivel axis; and shortening said tensioner so as to rotate said conical concave crushing bowl relative to said conical convex crushing head so as to adjust said conical concave crushing bowl relative to said conical convex crushing head.

* * * * *